US005135192A

United States Patent [19]

Winkler

[11] Patent Number: 5,135,192

[45] Date of Patent: Aug. 4, 1992

[54] GROUND ANCHOR

[76] Inventor: Dennis J. Winkler, 2860 Sheldon Dr., Oshkosh, Wis. 54904

[21] Appl. No.: 716,225

[22] Filed: Jun. 17, 1991

[51] Int. Cl.[5] ..... A45F 3/44

[52] U.S. Cl. ..... 248/156; 52/157; 248/545

[58] Field of Search ..... 248/156, 500, 499, 530, 248/545; 52/157, 165, 163, 164, DIG. 11; 135/118

[56] References Cited

U.S. PATENT DOCUMENTS

| | | | |
|---|---|---|---|
| 94,124 | 8/1869 | Middleton | 52/157 |
| 832,565 | 10/1906 | Wilson | 52/157 |
| 891,448 | 6/1908 | Snider | 52/165 X |
| 906,438 | 12/1908 | Lemerand | 52/157 X |
| 907,799 | 12/1908 | Hawley | 52/157 |
| 3,317,168 | 5/1967 | Ziph | 248/156 |
| 3,840,203 | 10/1974 | Sheehy | 248/156 X |
| 4,162,789 | 7/1979 | Hollaway | 52/157 X |
| 4,297,962 | 11/1981 | Johnson | 248/499 X |
| 4,920,897 | 5/1990 | Reed | 248/156 X |
| 4,923,165 | 5/1990 | Cockman | 52/157 X |

FOREIGN PATENT DOCUMENTS

| | | | |
|---|---|---|---|
| 94334 | 1/1939 | Sweden | 52/157 |
| 23502 | of 1904 | United Kingdom | 248/156 |
| 2195373 | 4/1988 | United Kingdom | 52/165 |

*Primary Examiner*—J. Franklin Foss

*Attorney, Agent, or Firm*—Donald Cayen

[57] ABSTRACT

A ground anchor comprises a flat plate and a helical rod extending at a right angle from one surface of the plate. A retaining member for removably receiving a selected object is permanently attached to the plate second surface. The retaining member may be a receptacle for holding a fence post or the like, or the retaining member may be a ring for typing a rope thereto for holding down such items as tents and nursery stock.

5 Claims, 2 Drawing Sheets

GROUND ANCHOR

BACKGROUND OF THE INVENTION

1. Field of the Invention

This invention pertains to hold down devices, and more particularly to apparatus for securing objects to the ground.

2. Description of the Prior Art

Various products have been developed to secure posts, poles, and the like to the ground. For example, U.S. Pat. Nos. 3,286,962; 3,317,168; and 4,454,824 show devices that support posts vertically on the ground by means of components that include skewers or augers embedded into the ground. U.S. Pat. No. 4,593,872 discloses a post holding sleeve that is held in a bayonet fashion to a screw that is turned into the ground.

U.S. Pat. No. 3,840,203 shows a base plate and tube for supporting non-vertical posts on the ground. The base plate of the U.S. Pat. No. 3,840,203 is retained to the ground by a pin driven into the ground and hooked into the base plate.

Prior hold down devices are also capable of securing items other than posts and the like to the ground. For instance, U.S. Pat. No. 4,072,286 describes a hoop type clamp retained flat on the ground by a screw or auger. U.S. Pat. No. 3,743,289 shows a skewer used to secure a baseball base in place on the ground.

Although the prior hold-down devices are generally suitable for their intended purposes, they nevertheless possess certain disadvantages. Most of the known hold downs are composed of two or more components that require assembly or other manipulation in order for them to hold a desired object in place. Other devices are designed to secure only specific objects, thereby limiting their usefulness. Consequently, the prior devices are either undesirably expensive to manufacture and complicated to use, or they are unsuitable for the particular purpose at hand.

Thus, a need exists for improvements in products for securing objects to the ground.

SUMMARY OF THE INVENTION

In accordance with the present invention, a versatile and inexpensive ground anchor is provided that is capable of securing a variety of objects to the ground. This is accomplished by apparatus that includes a coarse screw extending from one surface of a flat plate and a selected retaining member attached to the other surface of the plate.

The flat plate may be of any size and shape to suit the object to be secured to the ground and the contour of the ground surface. The screw is made as a long rod wound into a helix and having a longitudinal axis. One end of the rod is bent into a section that lies in a plane perpendicular to the screw axis. Preferably, the bent end section is formed into a generally semi-circular loop. The semi-circular loop is welded to the plate bottom surface, thereby creating a rigid joint between the plate and screw. Depending on the soil type and the application for the ground anchor, the screw may be from approximately seven inches to nine inches long and have an outer diameter of approximately two inches.

In one embodiment of the invention, the retaining member is in the form of a tube welded or otherwise attached to the plate second surface. The tube may be round and have its longitudinal axis at an angle to the plate. That embodiment is especially suitable for receiving the end of a pole associated with a swing set or a boat dock.

In another embodiment, the retaining member is a tube having its axis substantially perpendicular to the plane of the plate. The retaining member cross section may be rectangular or round for receiving a fence post, mail box post, or deck post. A rectangular retaining member may be made as two upstanding channels having the free ends of their respective side legs abutting and welded together.

A third embodiment employs a retaining member that is in the form of a ring attached to the flat plate second surface. The ring may be rigidly fixed to the plate, or the ring may swivel on the plate. The ring is very convenient for tying lines associated with a wide variety of objects such as airplanes, tents, and trees.

In all embodiments, the ground anchor is used by rotating it to cause the screw to penetrate the ground until the plate first surface rests on the ground. The object to be secured by the ground anchor is set in place, either within the retaining member, or adjacent the ground anchor and tied to the retaining member. The ground anchor thus functions in an inexpensive and convenient manner to secure a wide variety of objects in place on the ground.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
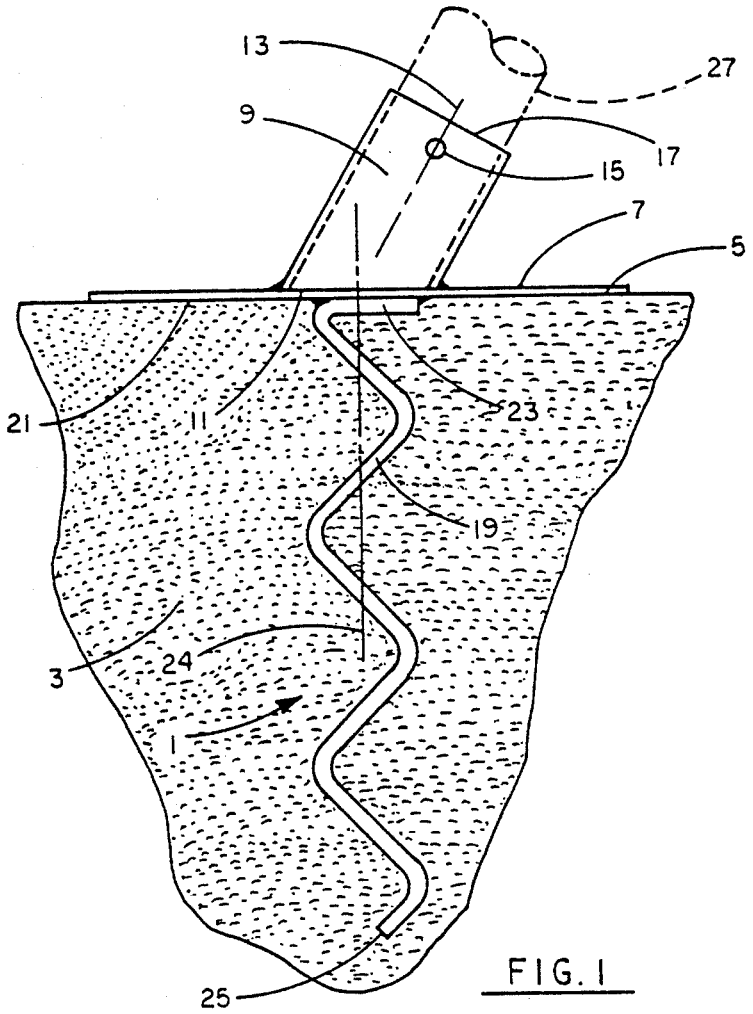
FIG. 1 is a side view of the ground anchor of the present invention.
Figure 2:
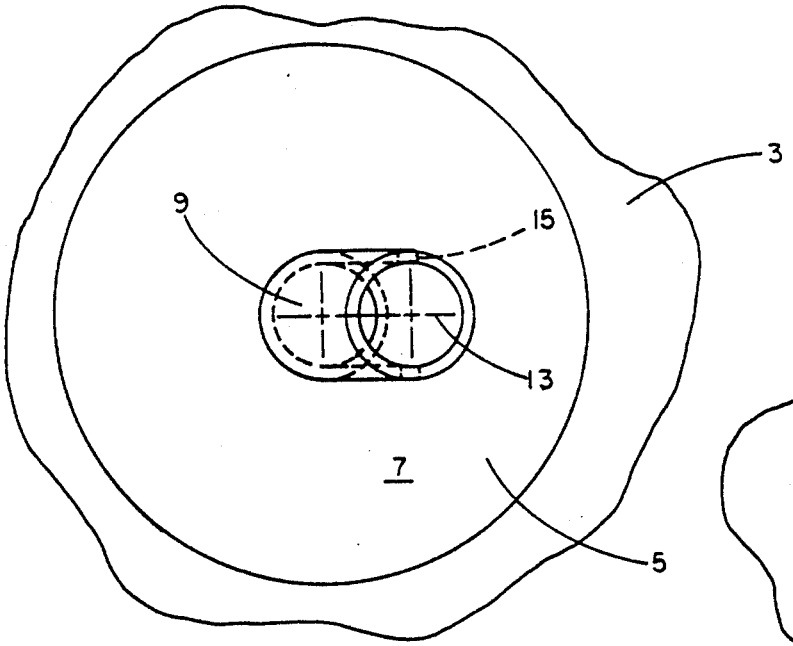
FIG. 2 is a top view of FIG. 1.
Figure 3:
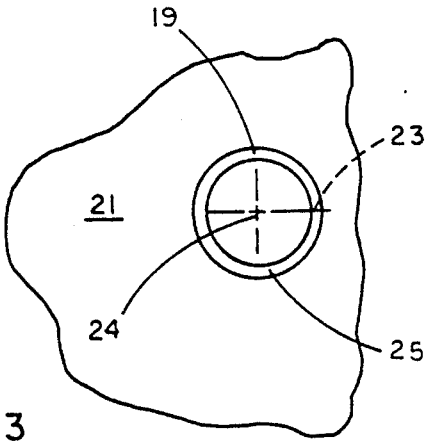
FIG. 3 is a bottom view of FIG. 1.

Referring to FIGS. 1–3, a ground anchor 1 is illustrated that includes the present invention. The ground anchor is particularly useful for securing a wide variety of objects, typically represented by pole 27, to the ground 3 in an economical and convenient fashion.

The ground anchor 1 is comprised of a flat plate 5, which, in the illustrated construction, is round in shape and has a diameter of approximately seven inches. Fourteen gauge sheet steel works very well for the plate 5. Attached to the top surface 7 of the plate is a retaining member in the form of a round tube 9. I prefer that the tube 9 have an outer diameter of approximately 1.75 inches, an eleven gauge wall thickness, and a three inch length. One end 11 of the tube 9 is cut at 30 degrees to the tube longitudinal axis 13. The tube end 11 is welded to the plate surface 7. A hole 15 extends transversely through the tube near its free end 17.

To secure the plate 5 and tube 9 to the ground, the ground anchor 1 further comprises a helical rod or screw 19 extending from the plate bottom surface 21. In the preferred embodiment, the screw 19 has a first end section 23 that is generally in the form of a semi-circle. The semi-circular end section 23 lies in a plane that is generally perpendicular to the screw longitudinal axis 24. The end section 23 lies flat against and is welded to the plate bottom surface 21. The screw second end 25 may be sharpened. The screw may be of any size and shape that suits the particular soil and application. I have found that a screw made of a 0.31 inches diameter rod coiled into a helix with a two inch outer diameter and with a finished length of approximately seven inches works very well for many installations.

In use, the screw point 25 is placed on the surface of the ground 3 with the plate 5 parallel to the ground surface. The plate is rotated such that the screw point 25 and the entire screw 19 enters the ground in auger fashion until the plate bottom surface 21 contacts the ground. The plate is rotated for adjustment until the tube axis 13 is oriented in the desired direction. The ground anchor is then firmly in place to receive a pole 27 of a swing set, boat dock, or similar member in the tube. The pole 27 may be positively held in place by a pin passing through the pole and the tube holes 15. Once in place, the ground anchor 1 will not pull out or shift under normal use, nor will it work out of the ground due to frost related soil movements. On the other hand, when the ground anchor is no longer needed, it can be intentionally removed from the ground merely by rotating it in a reverse direction until the screw is free. The ground anchor is then ready to be used again in a new location.

Figure 5:
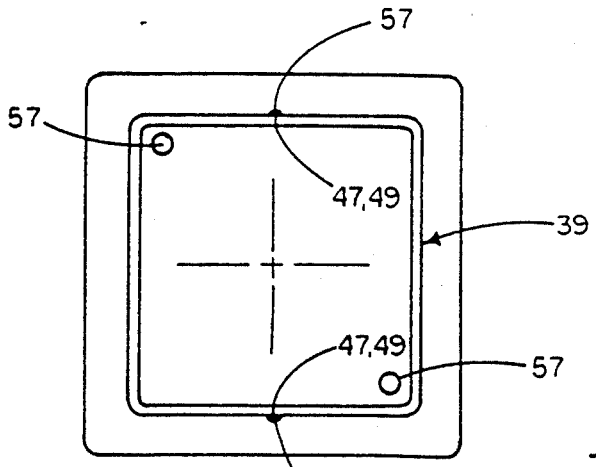
FIG. 5 a top view of FIG. 4.
Figure 6:
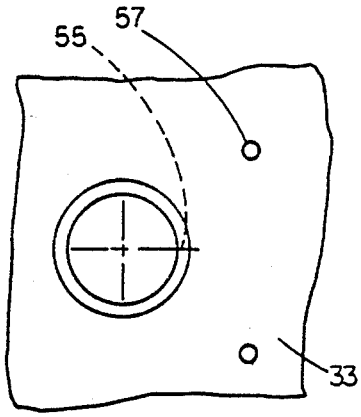
FIG. 6 a bottom view of FIG. 4.
Figure 4:
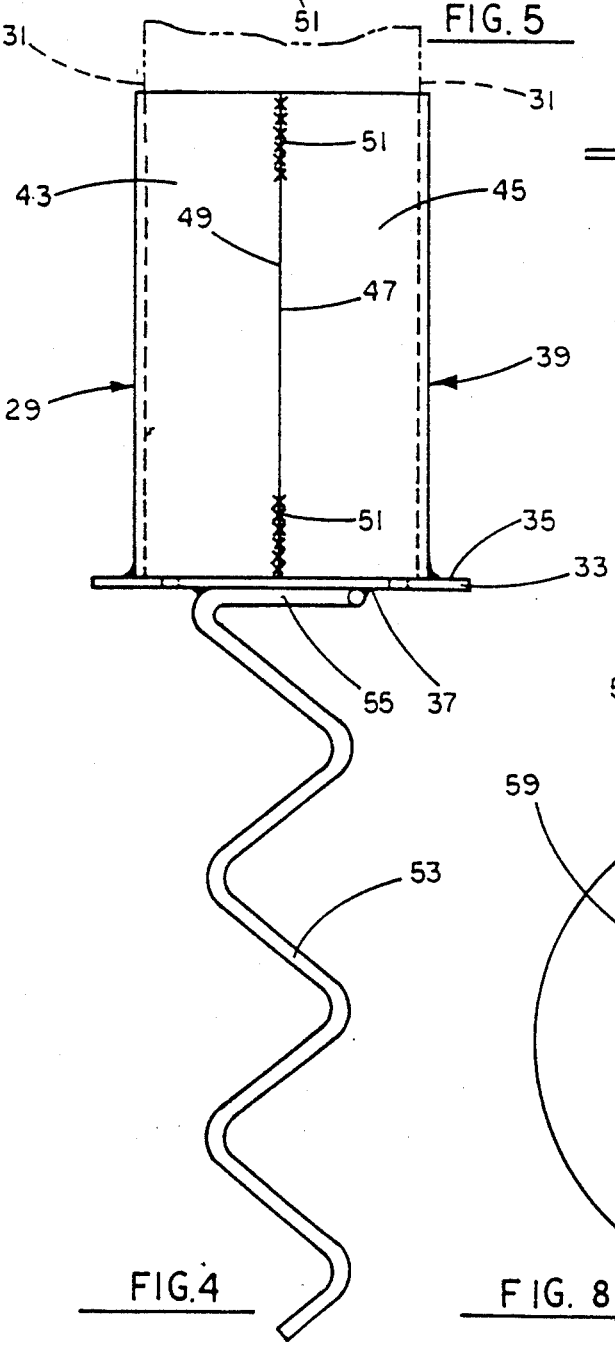
FIG. 4 is a side view of a modified embodiment of the present invention.

FIGS. 4–6 show a modified ground anchor 29 that is designed to support a selected object 31 in a vertical attitude. The ground anchor 29 has a flat plate 33 with top and bottom surfaces 35 and 37, respectively. The plate 33 may be square, as shown, or round or rectangular to suit a particular application and the ground contour.

To the plate top surface 35 is welded a retaining member 39. The retaining member 39 is shown as a tube with a square cross section, but, like the plate 33, the tube may have a round or rectangular cross section. The tube axis 41 is perpendicular to the plane of the plate. A preferred construction for the tube consists of two channels 43 and 45 with the free ends of their respective side legs 47 and 49 abutting and stitched together with welds 51.

The ground anchor 29 includes a screw 53 that has a semi circular end section 55 welded to the plate bottom surface 37. The screw 53 may be generally similar to the screw 19 described previously in connection with the ground anchor 1 of FIGS. 1–3. Other suitable components for the ground anchor 29 include a plate 33 that is 4.63 inches square and made of fourteen gauge sheet steel, two 1.81 by 3.63 inch channels six inches long, and a 0.31 inch diameter rod formed into a helix having a 2.50 inch outer diameter and a finished length of 9.5 inches.

The ground anchor 29 is used in generally the same manner as the ground anchor 1. When the ground anchor 29 is in place in the ground, the selected object 31 is inserted into the retaining member 39. The ground anchor 29 is especially suitable for holding fence posts, mail box posts, and the like vertically in place on the ground. Drain holes 57 in the plate 33 prevent water from accumulating within the retaining member.

Figure 7:
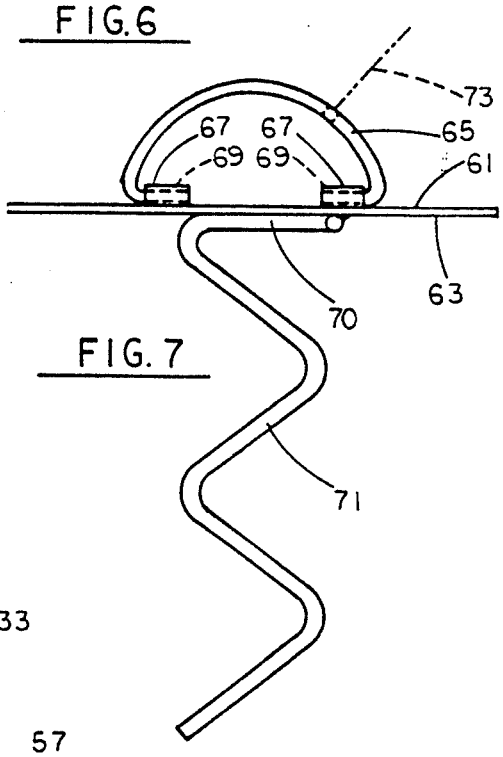
FIG. 7 is a side view of a further modified embodiment of the present invention.
Figure 8:
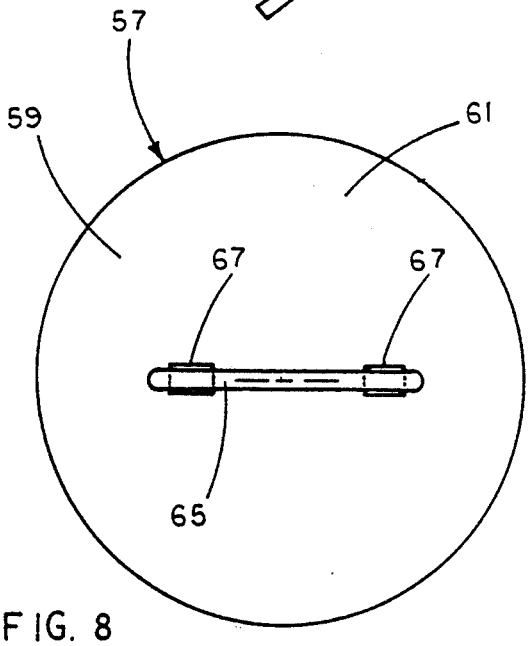
FIG. 8 is a top view of FIG. 7.

Turning to FIGS. 7 and 8, a further modified ground anchor 57 has a flat plate 59, which may be round, with top and bottom surfaces 61 and 63, respectively. To the top surface 61 of the plate 59 is attached a ring, such as a D-ring 65. The D-ring 65 may be welded in one position to the plate. I prefer, however, that the D-ring be swivelable within a pair of journals 67 that are welded to the plate and that receive the opposite ends 69 of the D-ring. The semi circular end section 70 of a helical rod or screw 71 is welded to the plate bottom surface 63. Satisfactory shapes and dimensions for the ground anchor 57 include a round fourteen gauge plate with a six-inch diameter, a D-ring made of 0.25 inch diameter rod, and a screw 71 made of 0.31 inch diameter rod configured into a helix having a finished length of approximately nine inches and an outer diameter of approximately two inches.

One end of a rope 73 is tied to the D-ring 65. The other end of the rope 73 may be tied to such diverse objects as airplanes, nursery stock, and tents. In that manner, ropes tied to the D-ring secure those objects to the ground.

Thus, it is apparent that there has been provided, in accordance with the invention, a ground anchor that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A ground anchor comprising:

a. a flat plate of predetermined size and thickness and having opposed first and second surfaces;

b. a rod formed into a helix having first and second ends and defining a longitudinal axis, the helical rod first end being formed into a section that is located in a plane perpendicular to the helix longitudinal axis and that lies against and is permanently fixed to the first surface of the flat plate; and c. retaining means permanently and rigidly attached to the second surface of the plate for removably receiving a selected object, wherein the retaining means comprises first and second channels having respective side legs with free ends, the channels being upstanding from the plate with the side legs thereof perpendicular to the plate, the free ends of the channel side lens abutting and being joined to each other to form a generally rectangular receptacle.

so that the helical rod can be screwed into the ground until the plate first surface contacts the ground and the selected object can be received within the rectangular receptacle for being secured to the ground by the ground anchor.

2. A ground anchor comprising:

a. a flat plate having top and bottom surfaces;

b. ring means secured to the plate top surface for enabling a rope or the like to be tied thereto, wherein the ring means comprises:

i. a ring having opposed free ends; and ii. journal means attached to the plate top surface for rotatingly receiving the ring free ends to thereby enable the ring to swivel relative to the plate; and c. screw means fixed to the plate bottom surface for screwing into the ground until the plate bottom surface is in contact therewith, so that the ground anchor is capable of tying a selected object at a location close to the ground.

3. Apparatus for securing a selected object to the ground comprising:

a. a flat plate having opposed top and bottom surfaces;

b. retaining means permanently attached to the plate top surface for removably retaining the selected object in place on the plate, wherein the retaining means comprises a pair of channels having respective side legs with free ends, the channels being upstanding from the plate top surface with the free ends of the channel side legs being joined together to form a generally rectangular receptacle for removably receiving the object; and c. a helical rod defining a longitudinal axis and having an end section that lies in a plane generally perpendicular to the longitudinal axis, the helical rod end section being fixed to the plate bottom surface with the helical rod longitudinal axis being generally perpendicular to the plate bottom surface.

4. The apparatus of claim 3 wherein the retaining means comprises:

a. a ring having opposed ends; and b. journal means attached to the plate top surface for receiving the ring opposed ends, so that the ring can swivel relative to the plate and a rope or the like can be remotely tied to the ring.

5. A method of securing an object to the ground comprising the steps of:

a. providing a flat plate with a helical rod extending from one side thereof and generally perpendicular thereto and a ring that is swivelably attached to the plate on the other side thereof;

b. screwing the helical rod into the ground until the plate contacts the ground surface; and c. tying one end of a rope or the like to the ring and the other end of the rope to the selected object to thereby secure the selected object to the ground.

* * * * *